US011250989B2

(12) United States Patent
Yanagi et al.

(10) Patent No.: US 11,250,989 B2
(45) Date of Patent: Feb. 15, 2022

(54) INTERNAL COMBUSTION ENGINE IGNITION DEVICE

(71) Applicant: Mitsubishi Electric Corporation, Tokyo (JP)

(72) Inventors: Shota Yanagi, Tokyo (JP); Takashi Idogawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 132 days.

(21) Appl. No.: 15/769,434

(22) PCT Filed: Apr. 12, 2016

(86) PCT No.: PCT/JP2016/061772
§ 371 (c)(1),
(2) Date: Apr. 19, 2018

(87) PCT Pub. No.: WO2017/179118
PCT Pub. Date: Oct. 19, 2017

(65) Prior Publication Data

US 2019/0035546 A1 Jan. 31, 2019

(51) Int. Cl.
*H01F 38/12* (2006.01)
*F02P 3/02* (2006.01)

(52) U.S. Cl.
CPC ..... *H01F 38/12* (2013.01); *F02P 3/02* (2013.01); *H01F 2038/122* (2013.01); *H01F 2038/127* (2013.01)

(58) Field of Classification Search
CPC ..... H01F 27/022; H01F 27/025; H01F 27/06; H01F 38/12; H01F 2038/122; H01F 2038/127; F02P 3/02
See application file for complete search history.

(56) References Cited

U.S. PATENT DOCUMENTS 5,357,233 A 10/1994 Wada
8,922,324 B2 * 12/2014 Idogawa ..... H01F 38/12 123/634

(Continued)

FOREIGN PATENT DOCUMENTS

JP 05-109554 A 4/1993
JP 05-335163 A 12/1993

(Continued)

OTHER PUBLICATIONS

Kamata, JP 2005-19869, machine translation. (Year: 2005).*

(Continued)

*Primary Examiner* — Hung Q Nguyen
*Assistant Examiner* — Mark L. Greene
(74) *Attorney, Agent, or Firm* — Sughrue Mion, PLLC; Richard C. Turner

(57) ABSTRACT

An internal combustion engine ignition device comprises: a center core; a primary coil wound on the outside of the center core; a secondary coil wound on the outside of the primary coil; a permanent magnet which abuts against one end of the center core and is magnetized in the inverse direction to the direction of a magnetic flux produced by the energization of the primary coil; a side core which is disposed on the outside of the secondary coil with one end abutted against the permanent magnet and the other end abutted against the center core, the side core cooperating with the permanent magnet to form a closed magnetic path; and a heat-resistant and elastic resin covering the side core with an opening at an outer peripheral side. Heat dissipation from the side core to a housing is improved without adversely affecting the dielectric strength voltage of the secondary coil.

15 Claims, 16 Drawing Sheets

(56) References Cited

U.S. PATENT DOCUMENTS

| | | | | |
|---|---|---|---|---|
| 2006/0226945 | A1 | 10/2006 | Maekawa et al. | |
| 2012/0299679 | A1 | 11/2012 | Kobayashi et al. | |
| 2017/0018352 | A1* | 1/2017 | Akimoto | F02P 3/05 |
| 2017/0309397 | A1 | 10/2017 | Kawai | |
| 2019/0214177 | A1* | 7/2019 | Idogawa | H01F 27/022 |

FOREIGN PATENT DOCUMENTS

| | | | | |
|---|---|---|---|---|
| JP | 08-017657 | A | | 1/1996 |
| JP | 2005019869 | A | * | 1/2005 |
| JP | 2006-294914 | A | | 10/2006 |
| JP | 2012-248645 | A | | 12/2012 |
| JP | 2013-247324 | A | | 12/2013 |
| JP | 2016-51789 | A | | 4/2016 |
| JP | 2016-081996 | A | | 5/2016 |

OTHER PUBLICATIONS

Communication dated Aug. 28, 2018, from the Japanese Patent Office in counterpart application No. 2018-511795.
International Search Report of PCT/JP2016/061772 dated Jul. 19, 2016.
Communication dated Feb. 19, 2019, from the Japanese Patent Office in counterpart application No. 2018-511795.
Office Action dated Apr. 28, 2020 in Chinese Application No. 201680083906.1.

* cited by examiner

INTERNAL COMBUSTION ENGINE IGNITION DEVICE

CROSS REFERENCE TO RELATED APPLICATIONS

This application is a National Stage of International Application No. PCT/JP2016/061772 filed Apr. 12, 2016.

TECHNICAL FIELD

The present invention relates to an internal combustion engine ignition device that supplies a high voltage to the ignition plug of an internal combustion engine.

BACKGROUND ART

Conventionally, an internal combustion engine ignition device includes a center core, a primary coil disposed on the outside of the center core so as to be wound around the center core, a secondary coil disposed so as to be wound around the center core on the outside of the primary coil, a magnet abutted against one end surface of the center core, the magnet being magnetized in the direction opposite to the direction of a magnetic flux produced by energization of the primary coil, a side core disposed on the outside of the primary coil and the secondary coil with one end abutted against the magnet and the other end abutted against the center core, the side core cooperating with the magnet to form a closed magnetic path, a case in which these members are housed, and an insulating resin with which the case is filled to fix these members. However, a crack may be generated in the insulating resin from the edge of the side core in this structure. If such a crack is generated, an electric field concentrates on the crack, the dielectric strength between the side core and the secondary coil is reduced, and the dielectric strength voltage is reduced.

As a measure against this, for example, PTL 1 proposes an internal combustion engine ignition coil in which the side core is covered with a flexible core cover. This can suppress the generation of a crack in the insulating resin and prevent the reduction in the dielectric strength voltage of the secondary coil.

CITATION LIST

Patent Literature

PTL 1: JP-A-2006-294914

SUMMARY OF INVENTION

Technical Problem

However, since the entire side core is covered with a flexible core cover in the conventional internal combustion engine ignition device in PTL 1, there is a problem in that the gap between the case and the side core becomes large, thereby causing the heat dissipation from the side core to be reduced and the outer dimensions of the device to be increased.

The invention addresses the problem described above with an object of providing an internal combustion engine ignition device that improves the heat dissipation from the side core without reducing the dielectric strength voltage of the secondary coil and has a small size.

Solution to Problem

To solve the above problem, an internal combustion engine ignition device according to the invention includes a stick center core; a primary coil wound on an outside of the center core; a secondary coil wound around an outside of the primary coil; a permanent magnet abutted against one end surface of the center core, the permanent magnet being magnetized in a direction opposite to a direction of a magnetic flux produced by energization of the primary coil; a side core disposed on an outside of the secondary coil with one end abutted against the permanent magnet and the other end abutted against the center core, the side core cooperating with the permanent magnet to form a closed magnetic path; and a heat-resistant and elastic resin covering a surface of the side core, in which a part of the resin is opened, the part covering at least an outer peripheral side of the side core.

Advantageous Effects of Invention

Since the internal combustion engine ignition device according to the invention is configured so that the part of the resin covering at least the outer peripheral side of the side core facing the housing is opened, it is possible to improve the heat dissipation from the side core to the housing without reducing the dielectric strength voltage of the secondary coil and reduce the device size.

DESCRIPTION OF EMBODIMENTS

Details on internal combustion engine ignition devices according to embodiments of the invention will be described with reference to FIG. 1 to FIG. 16.

Embodiment 1

Figure 1:
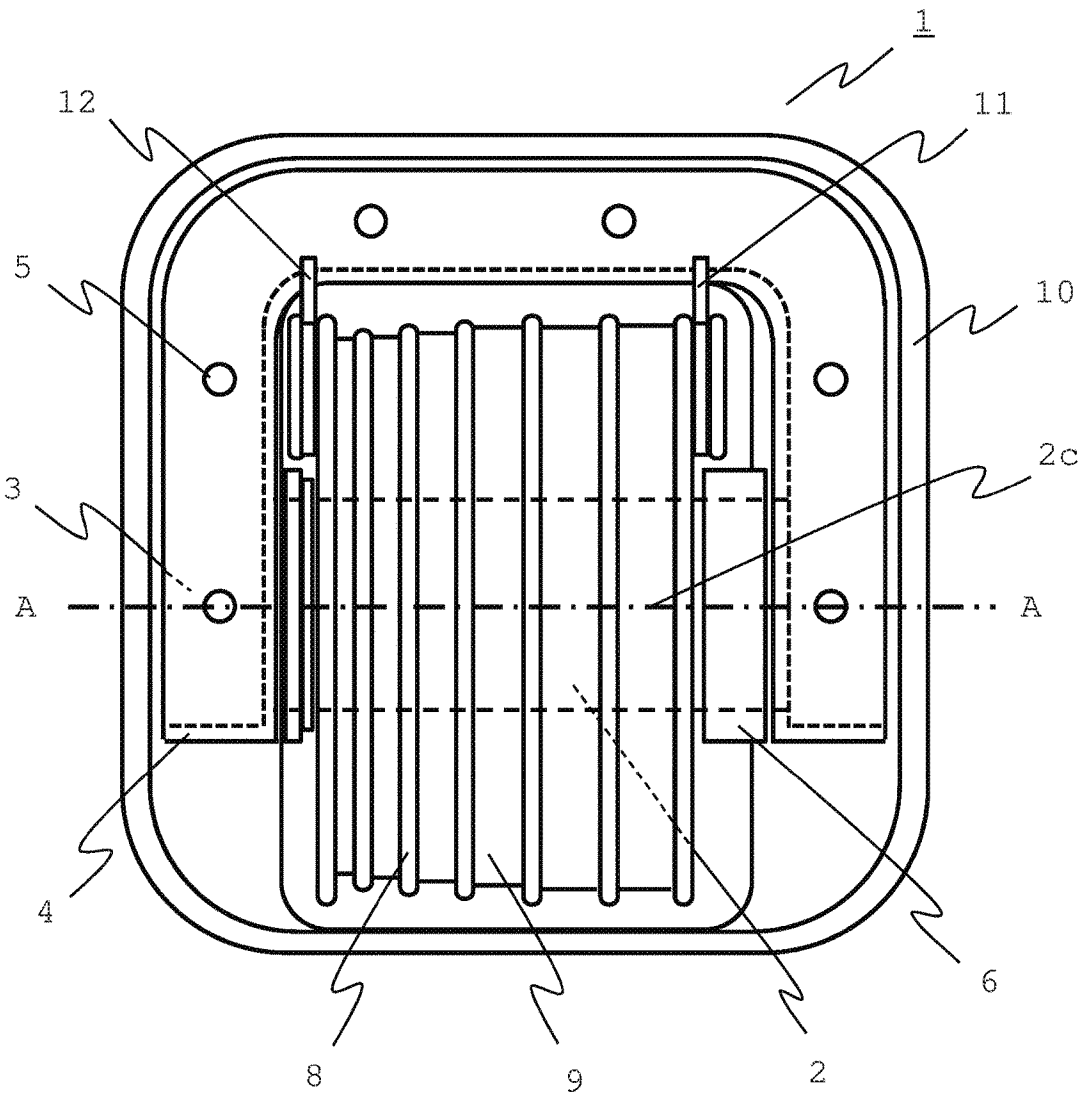
FIG. 1 is a plan view illustrating a first aspect of an internal combustion engine ignition device according to embodiment 1.
Figure 2:
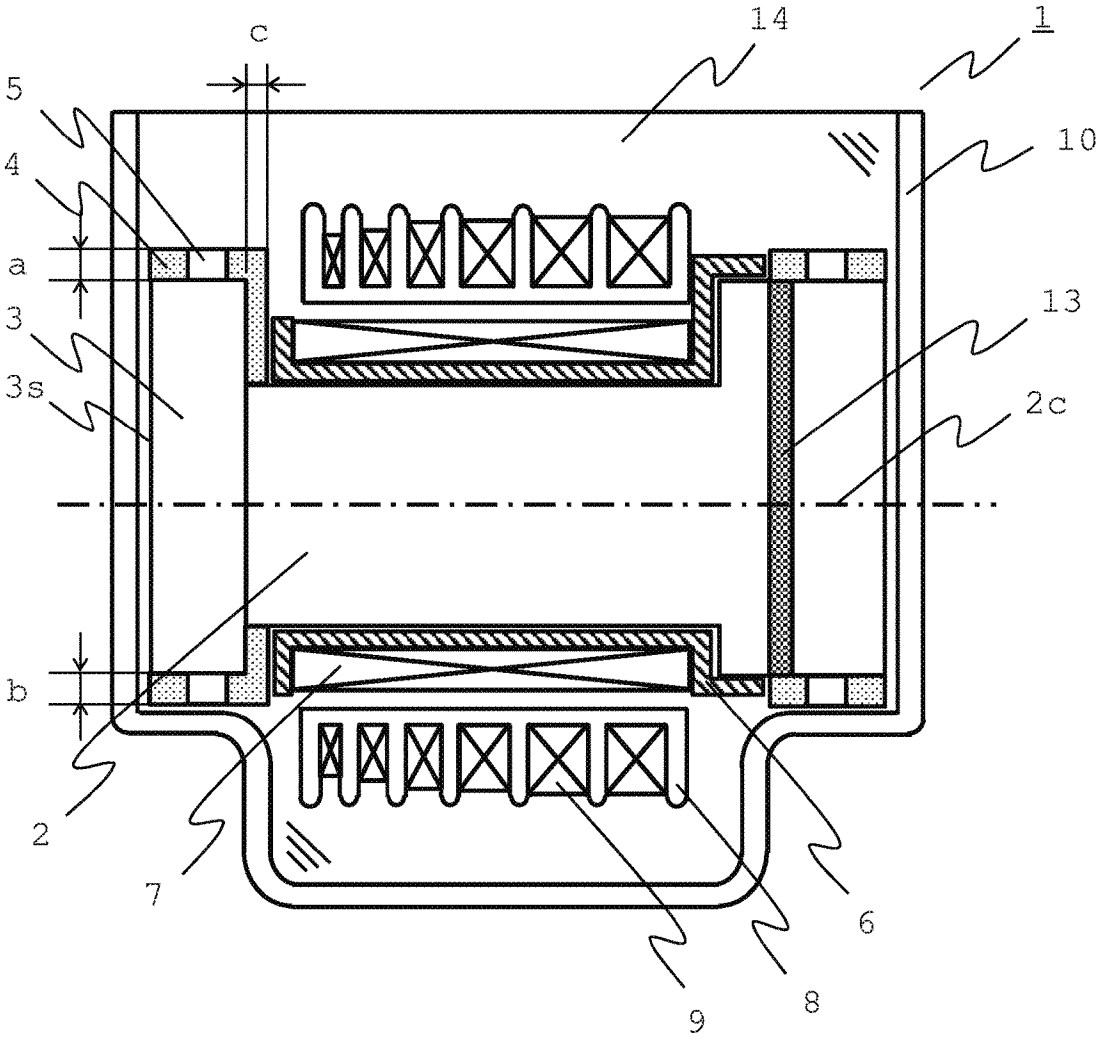
FIG. 2 is a cross sectional view taken along line A-A in FIG. 1.

FIG. 1 is a plan view illustrating the first aspect of the internal combustion engine ignition device according to embodiment 1. FIG. 2 is a cross sectional view taken along line A-A in FIG. 1.

As illustrated in FIG. 1, an internal combustion engine ignition device 1 includes a stick center core 2, a primary coil 7 provided on the outside of the center core 2, the primary coil 7 being wound around a primary bobbin 6 with respect to a center axis 2*c* of the center core 2, a secondary coil 9 provided on the outside of the primary coil 7, the secondary coil 9 being wound around a secondary bobbin 8 in a divided manner with respect to the center axis 2*c* of the center core 2, a low voltage side terminal 11 and a high voltage side terminal 12 provided on the secondary coil 9, a permanent magnet 13 abutted against one end of the center core 2, the permanent magnet 13 being magnetized in the direction opposite to the direction of a magnetic flux produced by energization of the primary coil 7, a U-shaped side core 3 disposed on an outside of the primary coil 7 and the secondary coil 9 with one end abutted against the permanent magnet 13 and the other end abutted against the center core 2, the side core 3 cooperating with the permanent magnet 13 to form a closed magnetic path, a heat-resistant and elastic resin 4 covering the surface of the side core 3, a housing 10 in which these members are housed, and an insulating resin 14 with which the housing 10 is filled. The resin 4 is provided with a through hole 5 and the part of the resin 4 covering an outer peripheral side 3*s* of the side core 3 is opened. FIG. 1 is a plan view illustrating a through hole 5 above the horizontal plane and above the side core 3. As seen in the cross-sectional view of FIG. 2, another through hole may be configured below the horizontal plane and below the side core 3. During assembly, individual components are housed in the housing 10 and the through hole 5 of the resin 4 is filled with the insulating resin 14 to improve the contact with the resin 4.

In the internal combustion engine ignition device 1, the center core 2 is magnetically coupled to the side core 3, a closed magnetic path is formed via the permanent magnet 13 for promoting the formation of a magnetic field magnetized in the direction opposite to the direction of a magnetic flux produced by energization of the primary coil 7, and a high voltage induced in the secondary coil 9 is supplied to the ignition plug of the internal combustion engine by passing the primary current through the primary coil 7 or interrupting the primary current. In some embodiments, a first end of the side core, a second end of the side core, and the center axis 2*c* extend in a horizontal plane when seen in a plan view (see FIG. 1, a plan view).

By opening the part of the resin 4 covering the outer peripheral side 3*s* of the side core 3, the gap between the side core 3 and the housing 10 can be reduced and the outer dimensions of the internal combustion engine ignition device 1 can be reduced. In addition, heat generated from the primary coil 7 and the secondary coil 9 can be radiated efficiently to the housing 10 by reducing the gap, and the thermal stress applied to the insulating resin 14 can be reduced and the occurrence of a crack in the insulating resin 14 can be suppressed by intervening the heat-resistant and elastic resin 4 between the side core 3 and the insulating resin 14. Since this can reduce the size of the internal combustion engine ignition device 1 without reducing the dielectric strength voltage of the secondary coil and improve the radiation efficiency, the reliability of the device can also be improved. As seen in the cross-sectional view of FIG. 2, the side core 3 has a height in a vertical direction. In some embodiments, the gap is disposed with a height substantially equal to the side core height such that the resin 4 is opened over the outer peripheral side of the side core 3*s*. To the right of FIG. 2, the permanent magnet 13 abuts a first end surface of the center core 2. To the left of FIG. 2, a second end surface of the center core 2 abuts the side core 3 without the permanent magnet 13 in-between. Thus, the gap is closer to the second end surface of the center core 2 than to the first end surface of the center core 2.

Preferably, the resin 4 is preferably heat-resistant elastomer resin such as silicone rubber. In addition, a hole used to fix the side core 3 when elastomer resin is molded onto the surface of the side core 3 may be used as the through hole 5 of the resin 4.

Since the outer peripheral side 3*s* of the side core 3 is not covered with the resin 4, by making the thicknesses a and b of the resin 4 on the upper and lower surfaces of the side core 3 larger than thickness c of the inner peripheral side of the side core 3 as illustrated in FIG. 2, it is possible to suppress the exfoliation of the resin 4 from the side core 3 due to thermal stress. In addition, since the outer peripheral side 3*s* of the side core 3 is not covered with the resin 4, the resin 4 does not make contact with the housing 10 during assembly and exfoliation of the resin 4 from the side core 3 can be prevented. As seen in the cross-sectional view of FIG. 2, a height of the side core 3 extends vertically and the center core has a height extending vertically. In some embodiments, the height and positioning of the side core 3 is such that the side core 3 extends vertically above a top of the center core 2 and the side core 3 extends vertically below a bottom of the center core 2.

Figure 3:
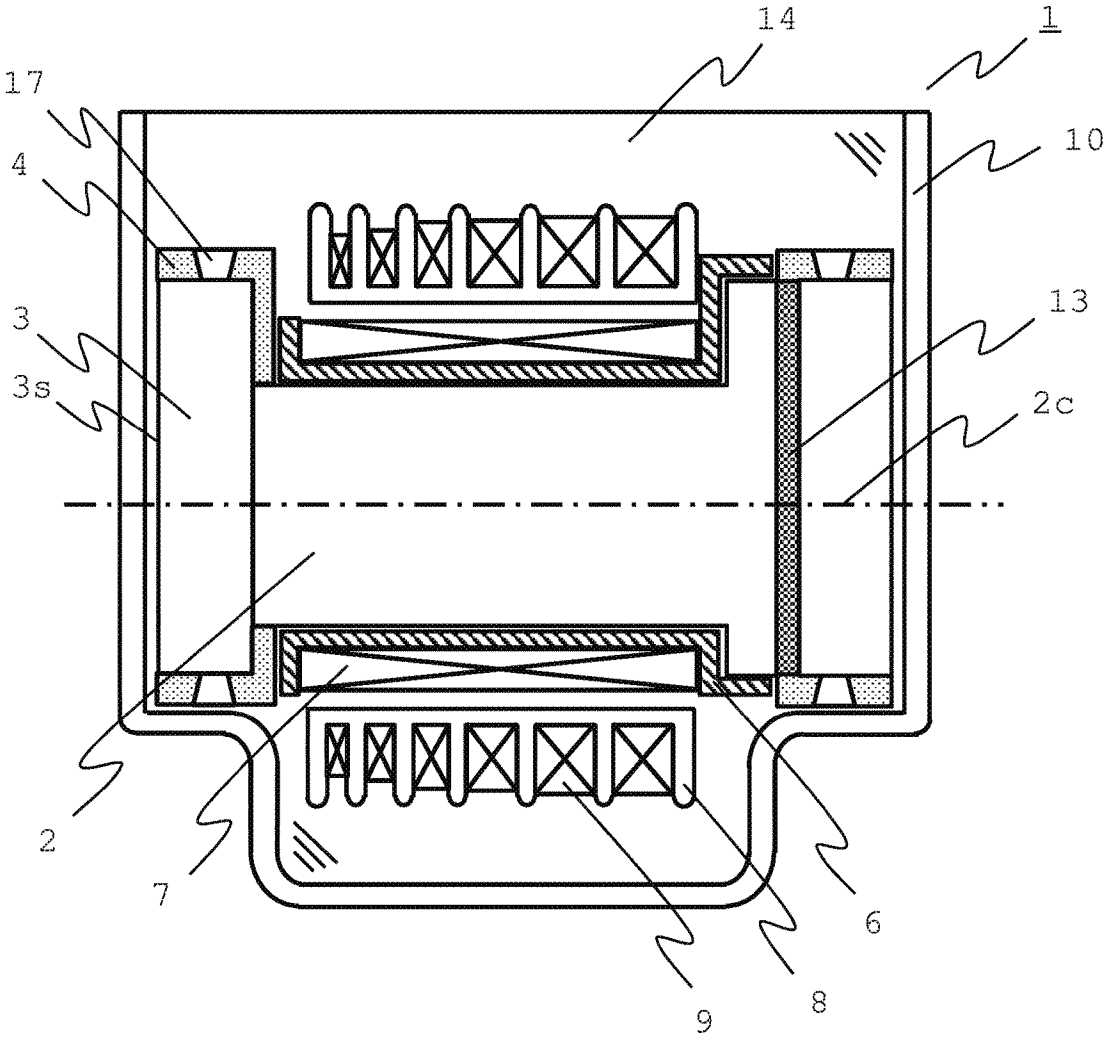
FIG. 3 is a cross sectional view illustrating the structure of a second aspect of the internal combustion engine ignition device according to embodiment 1.

FIG. 3 illustrates the second aspect of the embodiment and the resin 4 is provided with a through hole 17, as the through hole, having an upper portion and a lower portion having a diameter smaller than the upper portion. In this aspect, this causes the insulating resin 14 to be sufficiently distributed uniformly within the through hole 17 when the through hole 17 is filled with the insulating resin 14, and improves the contact.

Figure 4:
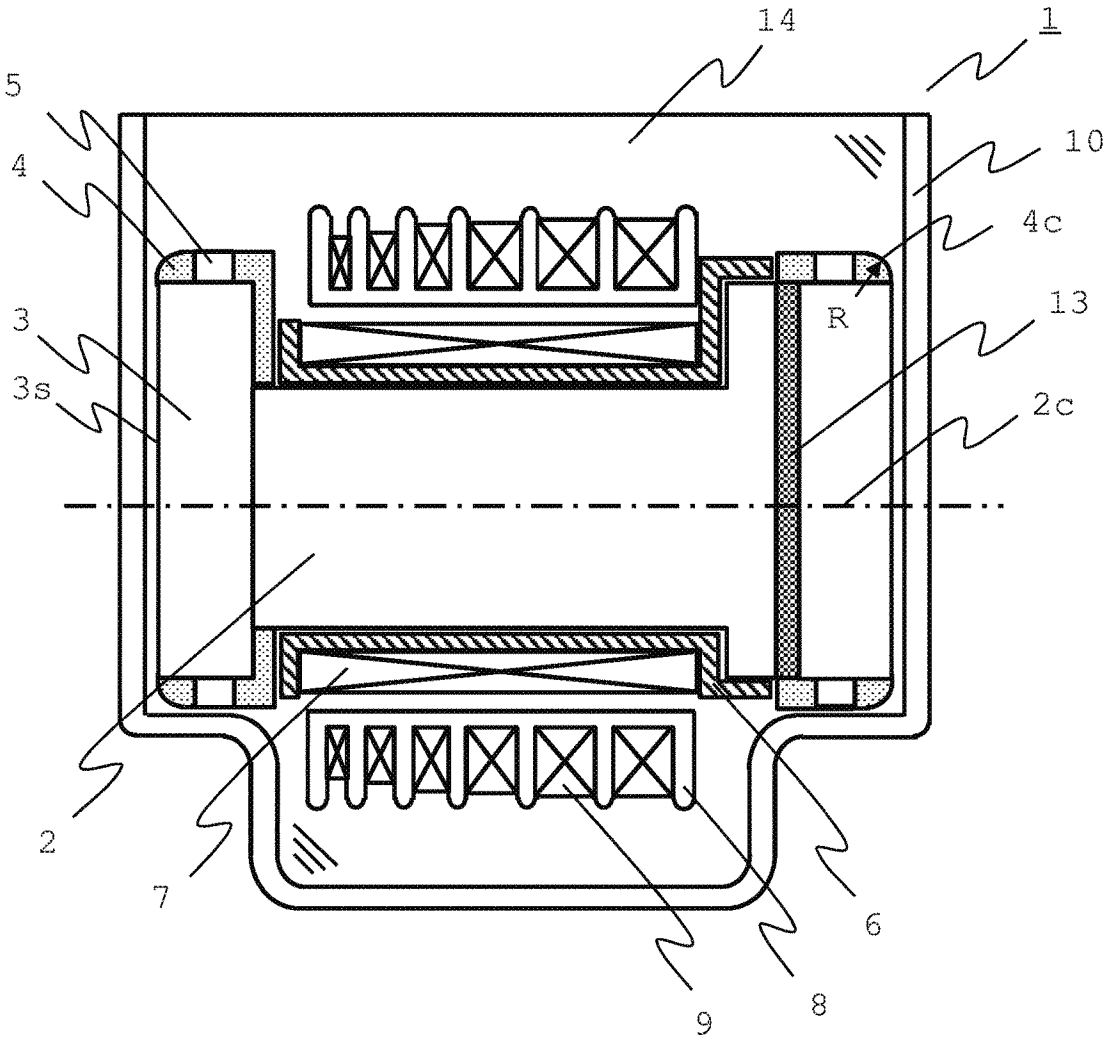
FIG. 4 is a cross sectional view illustrating the structure of a third aspect of the internal combustion engine ignition device according to embodiment 1.

FIG. 4 illustrates the third aspect of the embodiment. An edge portion 4*c* of the resin 4 is provided with a curved surface having a curvature of R. This can suppress the exfoliation of the resin 4 from the side core 3 due to contact or the like when the side core 3 is inserted into the housing during assembly. In addition, since the curvature improves the contact between the resin 4 and the side core 3. The edge portion of the resin 4 may be tapered instead of providing the curved surface. As seen in FIG. 4, in some embodiments, the curved surface is characterized by the curvature R and is configured to curve from a horizontal line to a vertical line. In some embodiments, the vertical line is approximately tangential to the outer peripheral surface of the side core.

Although the side core 3 is U-shaped in the description of the above embodiment, the side core 3 may have another shape such as an O-shape.

As described above, in the internal combustion engine ignition device according to embodiment 1, the gap between the side core and the housing can be reduced by opening the outer peripheral side of the side core covered with the resin, the size of the internal combustion engine ignition device can be reduced without reducing the dielectric strength voltage of the secondary coil, heat generated from the primary coil and the secondary coil can be radiated efficiently to the housing by reducing the gap, and the thermal stress applied to the insulating resin can be reduce and the occurrence of a crack can be suppressed by intervening the heat-resistant and elastic resin.

Embodiment 2

Figure 5:
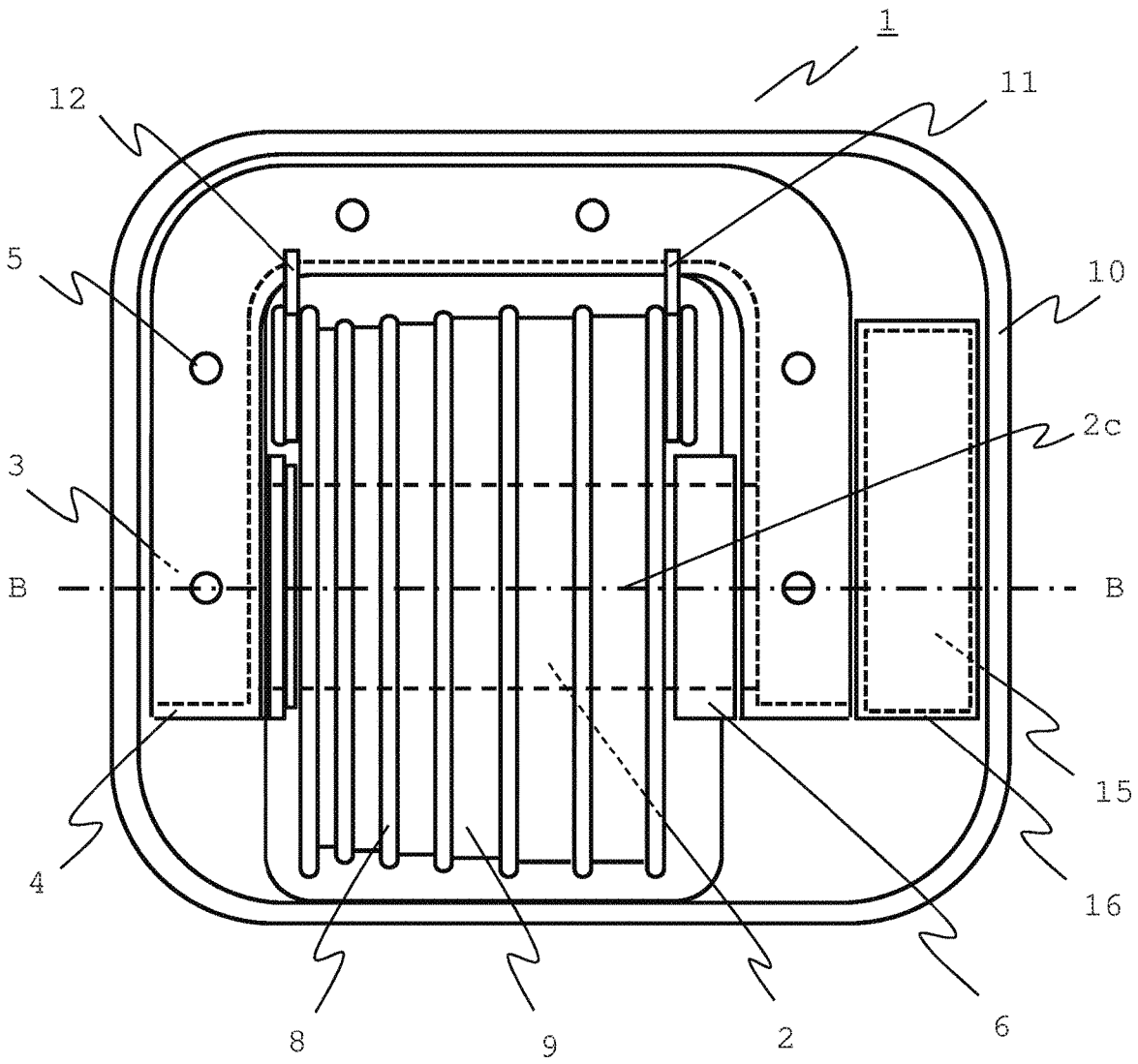
FIG. 5 is a plan view illustrating the structure of a first aspect of an internal combustion engine ignition device according to embodiment 2.
Figure 6:
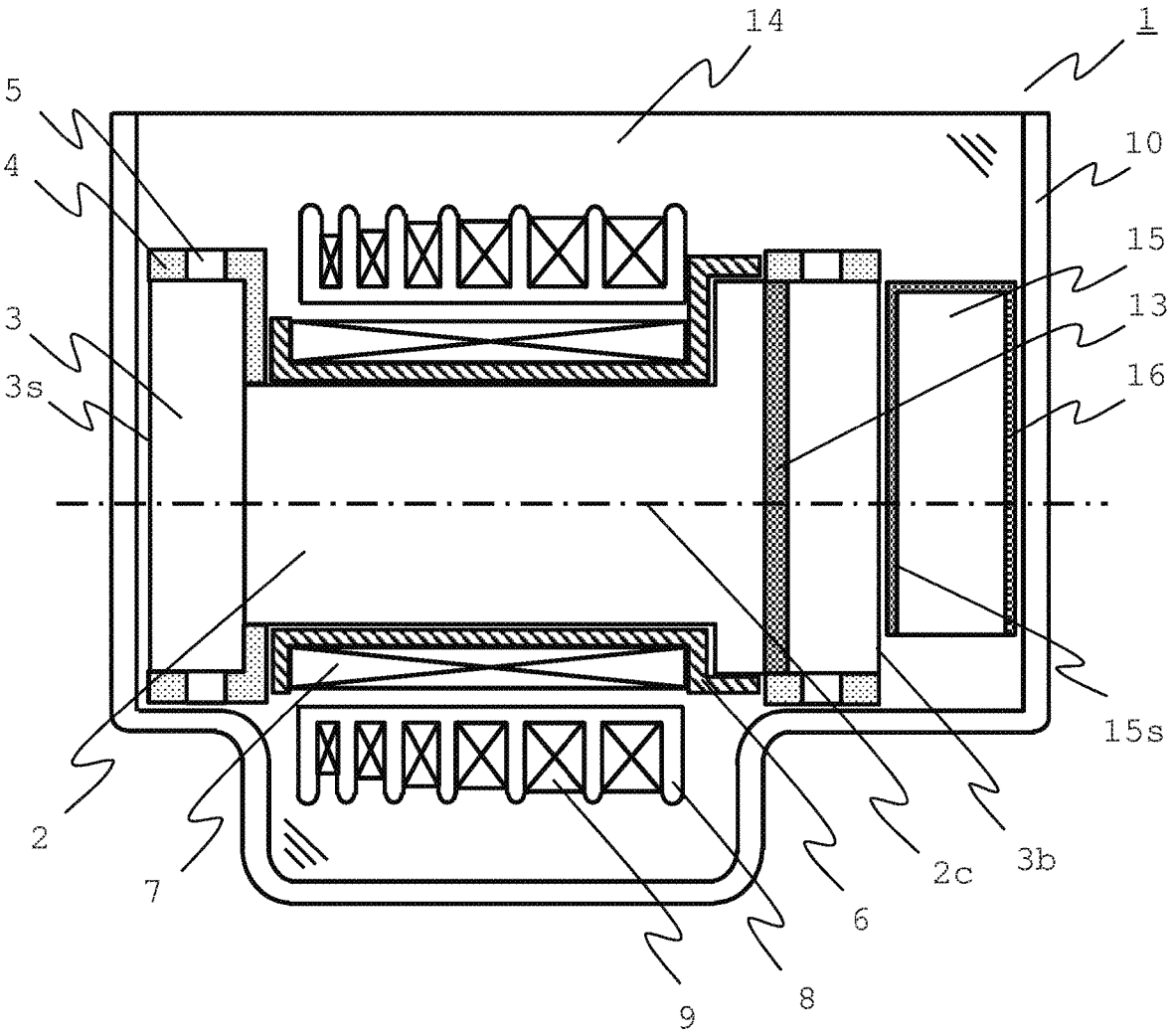
FIG. 6 is a cross sectional view taken along line B-B in FIG. 5.

FIG. 5 is a plan view illustrating the structure of a first aspect of the internal combustion engine ignition device according to embodiment 2. FIG. 6 is a cross sectional view taken along line B-B in FIG. 5. The internal combustion engine ignition device according to embodiment 2 is the same as that according to embodiment 1 except that the internal combustion engine ignition device according to embodiment 2 includes a switching module 15 in the housing 10. Since the other structure and operation of the internal combustion engine ignition device according to embodiment 2 are the same as those of the internal combustion engine ignition device according to embodiment 1, descriptions are omitted.

As illustrated in FIG. 5 and FIG. 6, the switching module 15 that supplies, to the ignition plug of an internal combustion engine, a high voltage induced in the secondary coil 9 by passing a primary current through the primary coil 7 or interrupting the primary current is covered with an elastic body 16 and disposed so that a side 15*s* of the switching module 15 faces the outer peripheral side 3*s* of the side core 3. The elastic body 16 relieves thermal stress applied to switching module 15 from the primary coil 7 and the secondary coil 9. Since the switching module 15 is covered with the elastic body 16 here, the part of the resin 4 covering the outer peripheral side 3*s* of the side core 3 is unnecessary and the part is opened. The elastic body 16 may be made of rubber or the like that has elasticity.

Figure 7:
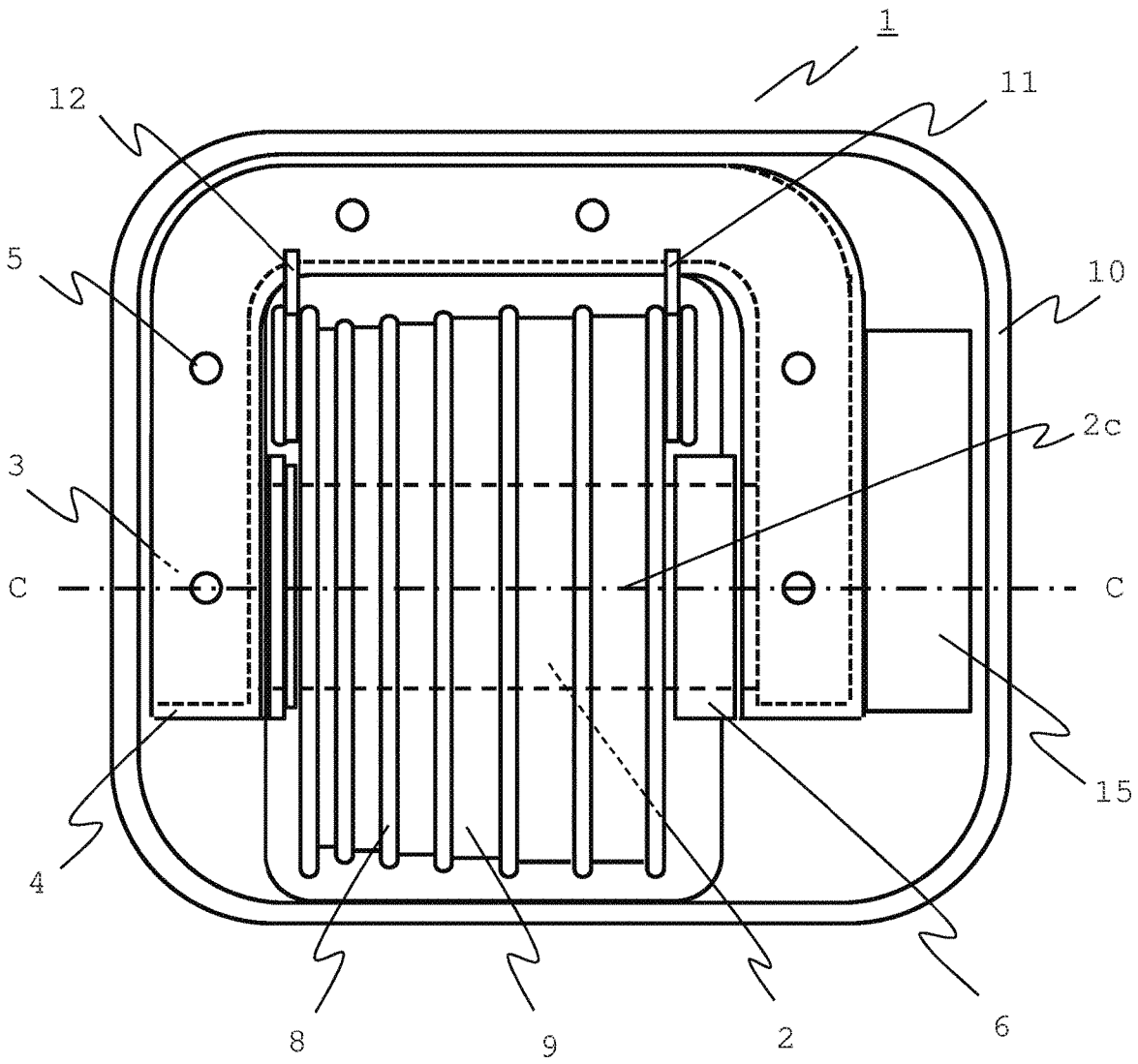
FIG. 7 is a plan view illustrating the structure of a second aspect of the internal combustion engine ignition device according to embodiment 2.
Figure 8:
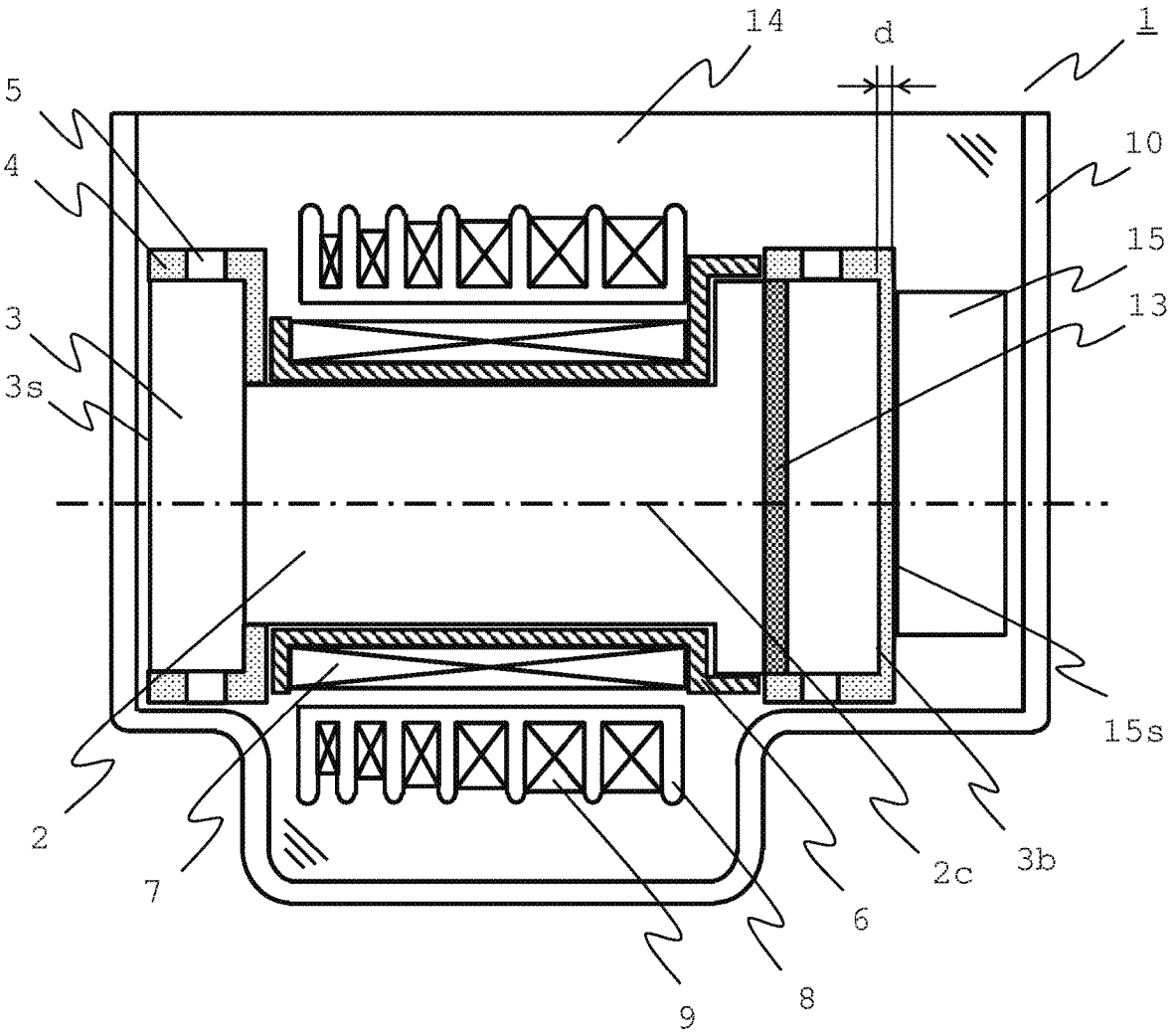
FIG. 8 is a cross sectional view taken along line C-C in FIG. 7.

In addition, FIG. 7 is a plan view illustrating the structure of the second aspect of the internal combustion engine ignition device according to embodiment 2. FIG. 8 is a cross sectional view taken along line C-C in FIG. 7. Here, the outer peripheral side 3*s* of the side core 3 close to the side 15*s* of the switching module 15 is covered with the resin 4 having a thickness of d. Since the outer peripheral side 3*s* of the side core 3 close to the switching module 15 is provided with the resin 4, the elastic body 16 of the switching module 15 for measure against thermal stress becomes unnecessary and the outer dimensions of the internal combustion engine ignition device 1 can be reduced. In this aspect, the resin 4 covering the outer peripheral side 3*s* of the side core 3 can relieve thermal stress applied to the switching module 15. The thickness d of the resin 4 only needs to protect the switching module 15 from thermal stress applied by the primary coil 7 and the secondary coil 9.

Since this takes measures against thermal stress applied to the switching module 15 and eliminates the need for the elastic body 16, the number of components can also be reduced.

As described above, in the internal combustion engine ignition device according to embodiment 2, the same effects as in embodiment 1 can be obtained even when the switching module is built into the housing and thermal stress applied to the switching module can be relieved.

Embodiment 3

Figure 9:
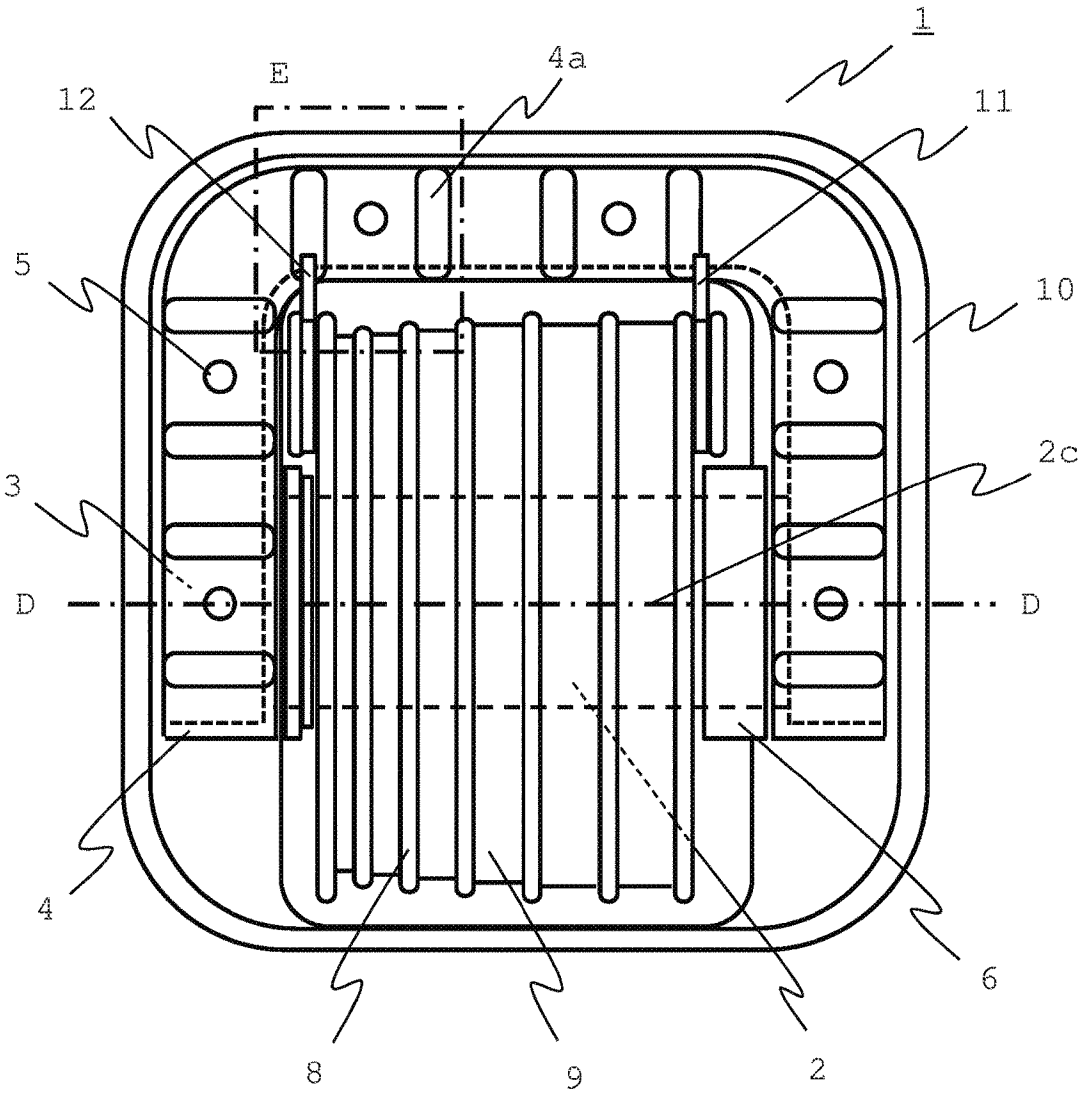
FIG. 9 is a plan view illustrating the structure of a first aspect of an internal combustion engine ignition device according to embodiment 3.
Figure 10:
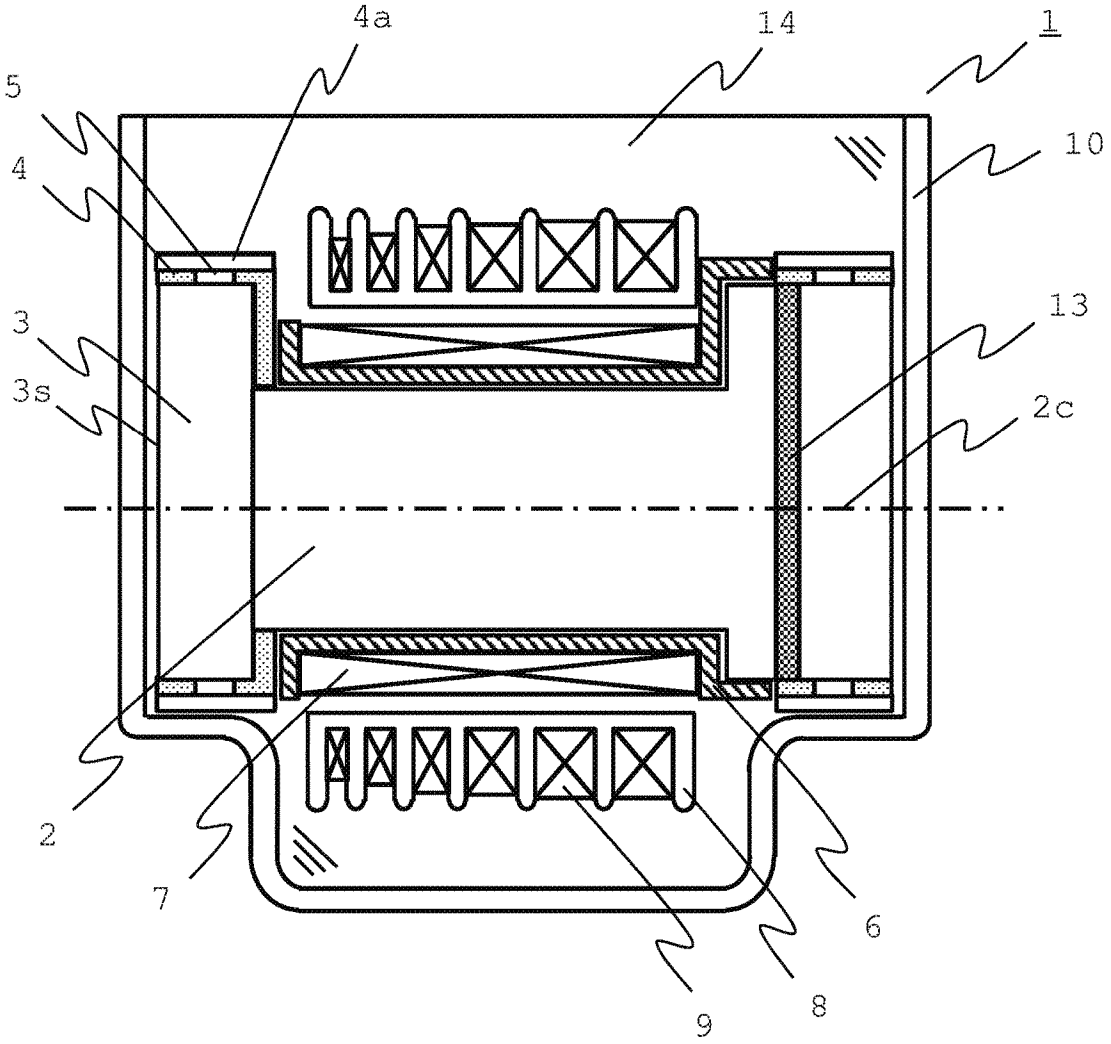
FIG. 10 is a cross sectional view taken along line D-D in FIG. 9.
Figure 11:
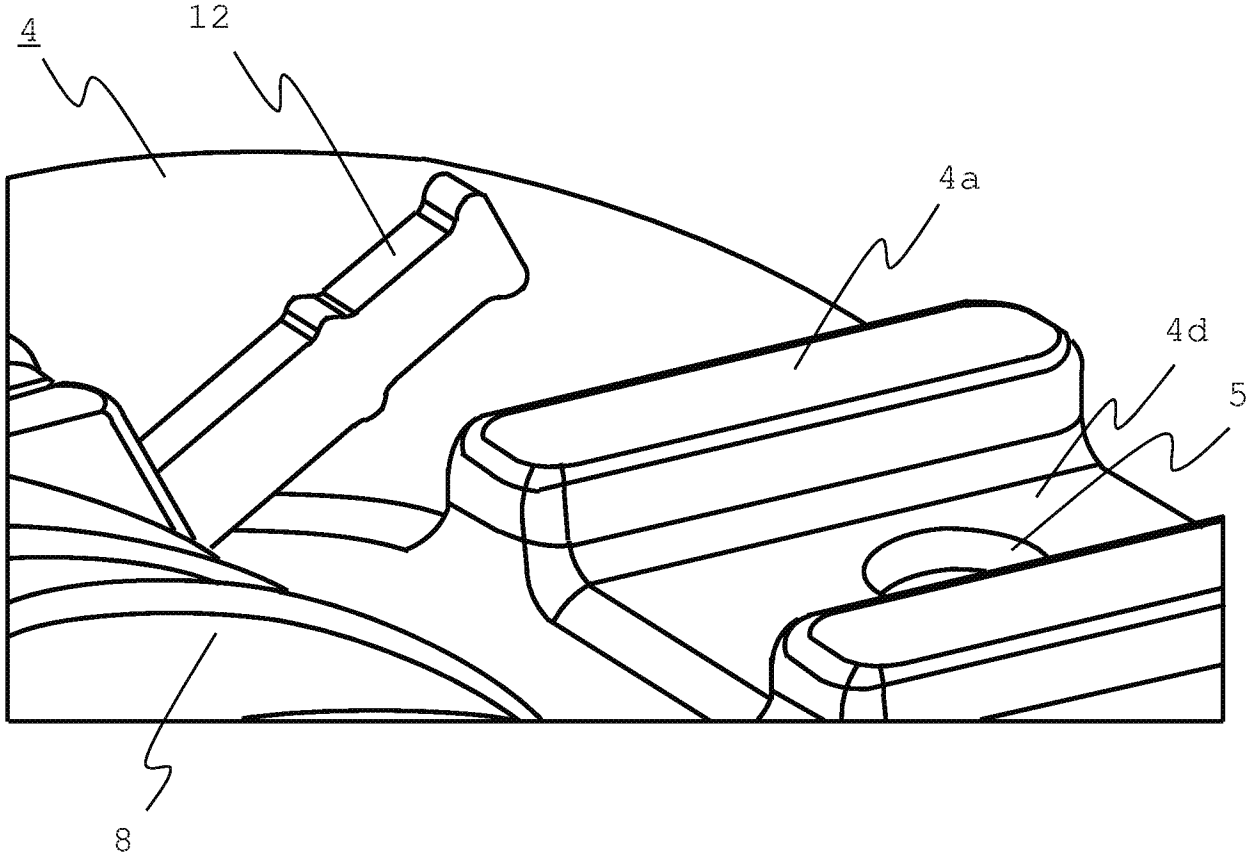
FIG. 11 is a partial perspective view illustrating section E in FIG. 9.

FIG. 9 is a plan view illustrating the structure of the first aspect of the internal combustion engine ignition device according to embodiment 3, FIG. 10 is a cross sectional view taken along line D-D in FIG. 9, and FIG. 11 is a partial perspective view illustrating section E in FIG. 9. This internal combustion engine ignition device is the same as the internal combustion engine ignition device according to embodiment 1 except that a ridge 4*a* is formed on the surface portion of the resin 4. Since the other structure and operation of the internal combustion engine ignition device according to embodiment 3 are the same as those of the internal combustion engine ignition device according to embodiment 1, descriptions are omitted.

As illustrated in FIG. 9 to FIG. 11, the ridge 4*a* only needs to be provided in a position other than the position of the through hole 5 provided in the resin 4 and the number of the ridges 4*a* and the position of the ridge 4*a* are not particularly limited. The presence of the ridge 4*a* on the resin 4 increases the strength, can relieve the stress applied when the resin 4 is molded to the side core 3, and can suppress the exfoliation of the resin 4 from the side core 3. In addition, the ridge 4*a* can relieve the thermal stress from the primary coil 7 and the secondary coil 9 and suppress exfoliation. This can suppress the thickness of a flat portion 4*d* of the resin 4 and reduce the amount of resin used, as compared with the case in which the resin 4 is configured to have a uniform thickness. It should be noted that as is clear from the partial perspective view illustrating section E in FIG. 9, a sufficient gap is taken between the high voltage side terminal 12 of the secondary coil 9 and the ridge 4*a*.

Figure 12:
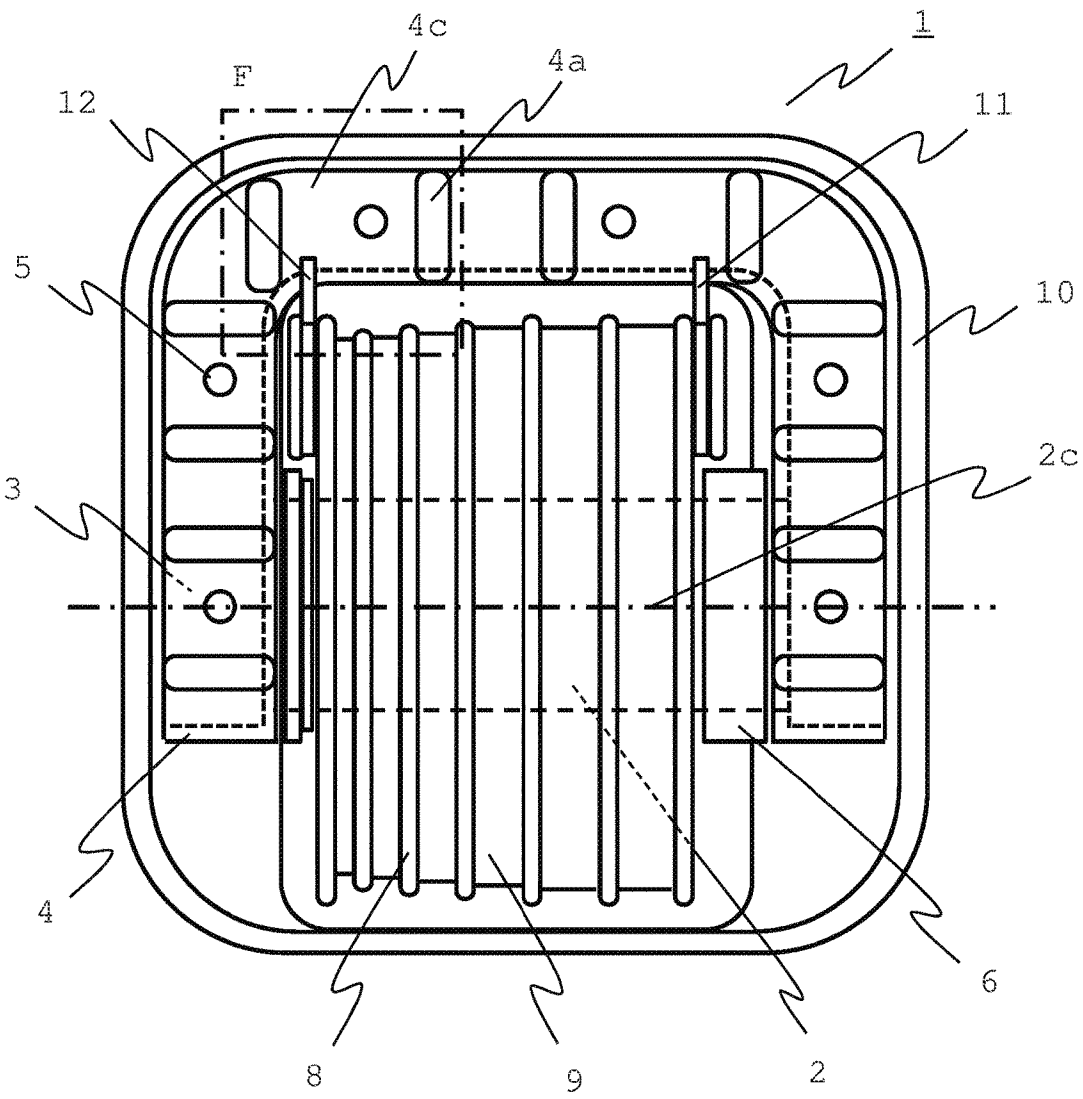
FIG. 12 is a plan view illustrating the structure of a second aspect of the internal combustion engine ignition device according to embodiment 3.
Figure 13:
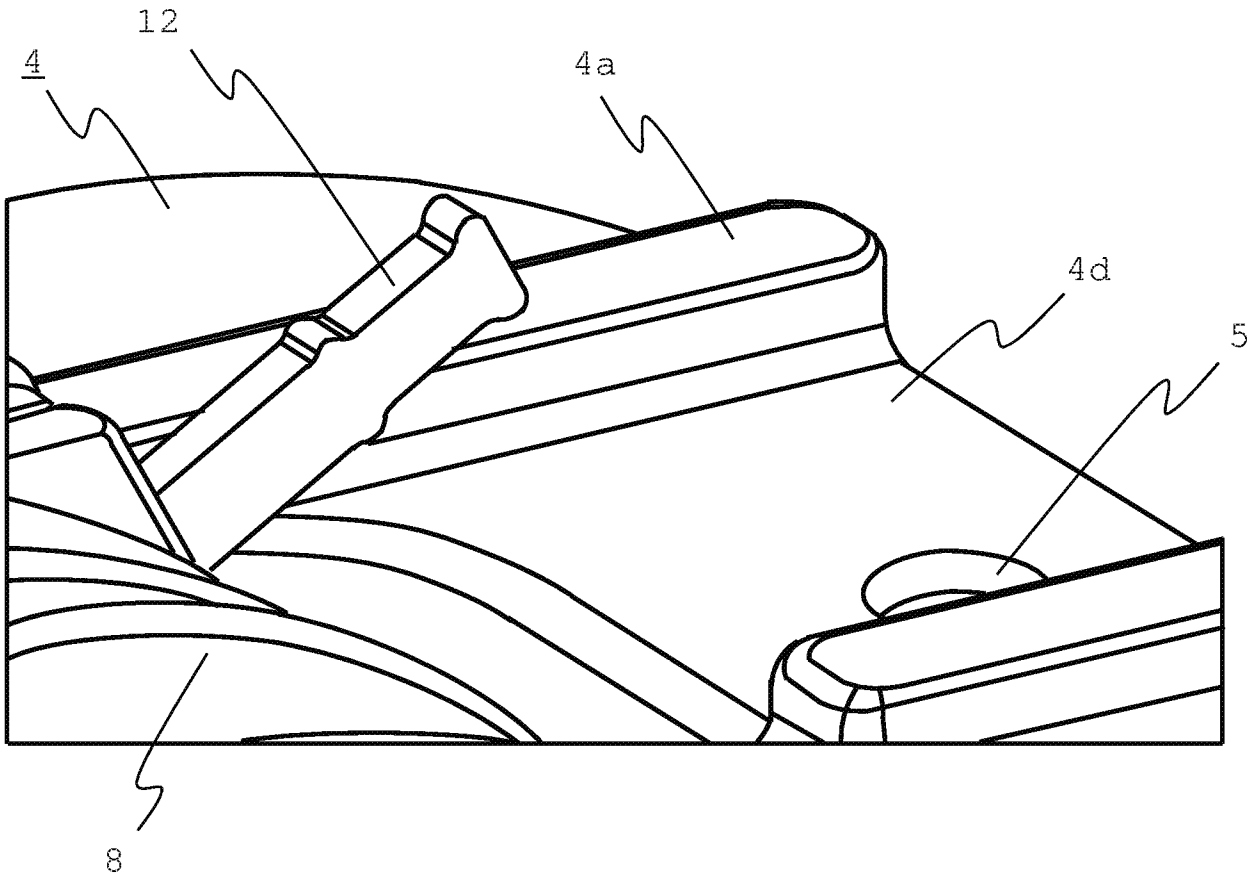
FIG. 13 is a partial perspective view illustrating section F in FIG. 12.

In addition, FIG. 12 is a plan view illustrating the structure of the second aspect of the internal combustion engine ignition device according to embodiment 3. FIG. 13 is a partial perspective view illustrating section F in FIG. 12. Here, the ridge 4*a* is provided in a position away from the high voltage side terminal 12 so that the high voltage side terminal 12 of the secondary coil 9 faces the flat portion 4*d* of the resin 4. Since the withstand voltage of the insulating resin 14 is higher than that of the resin 4, the amount of the insulating resin 14 around the high voltage side terminal 12 increases by keeping the flat portion 4*d* of the resin 4 away from the high voltage side terminal 12, the withstand voltage of the secondary coil 9 can be improved, and the internal combustion engine ignition device can have a small size and a high withstand voltage.

Figure 14:
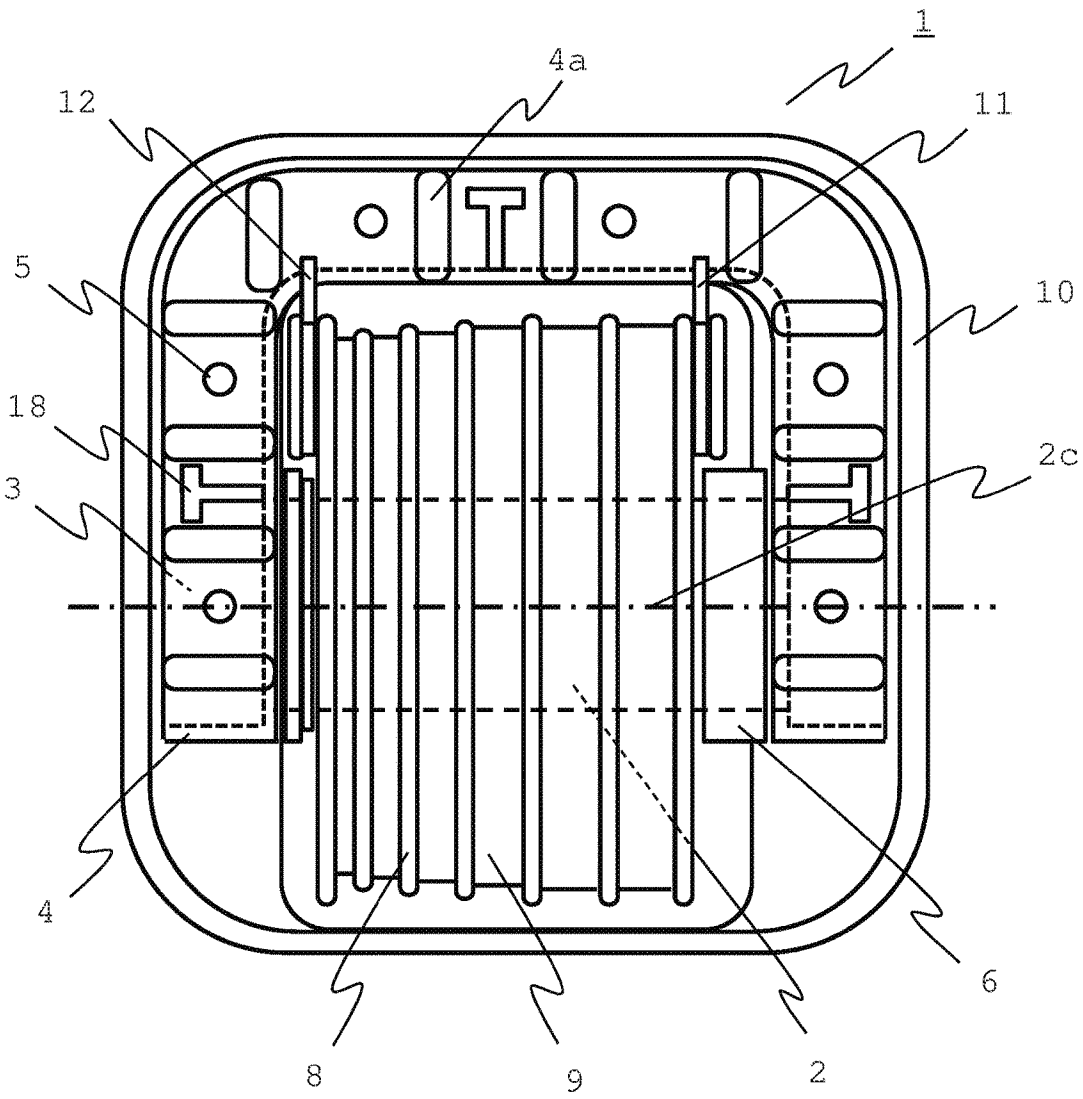
FIG. 14 is a plan view illustrating the structure of a third aspect of the internal combustion engine ignition device according to embodiment 3.

In addition, FIG. 14 is a plan view illustrating the structure of the third aspect of the internal combustion engine ignition device according to embodiment 3. Here, a T-shaped through hole 18 is provided in the resin 4 in addition to the through hole 5. The tensile stress applied in the radial direction and the longitudinal direction of the resin 4 can be relieved by providing an opening. The through hole 5 may be T-shaped. Of course, it will be appreciated that the resin in embodiment 1 that has no ridge is also applicable.

Figure 15:
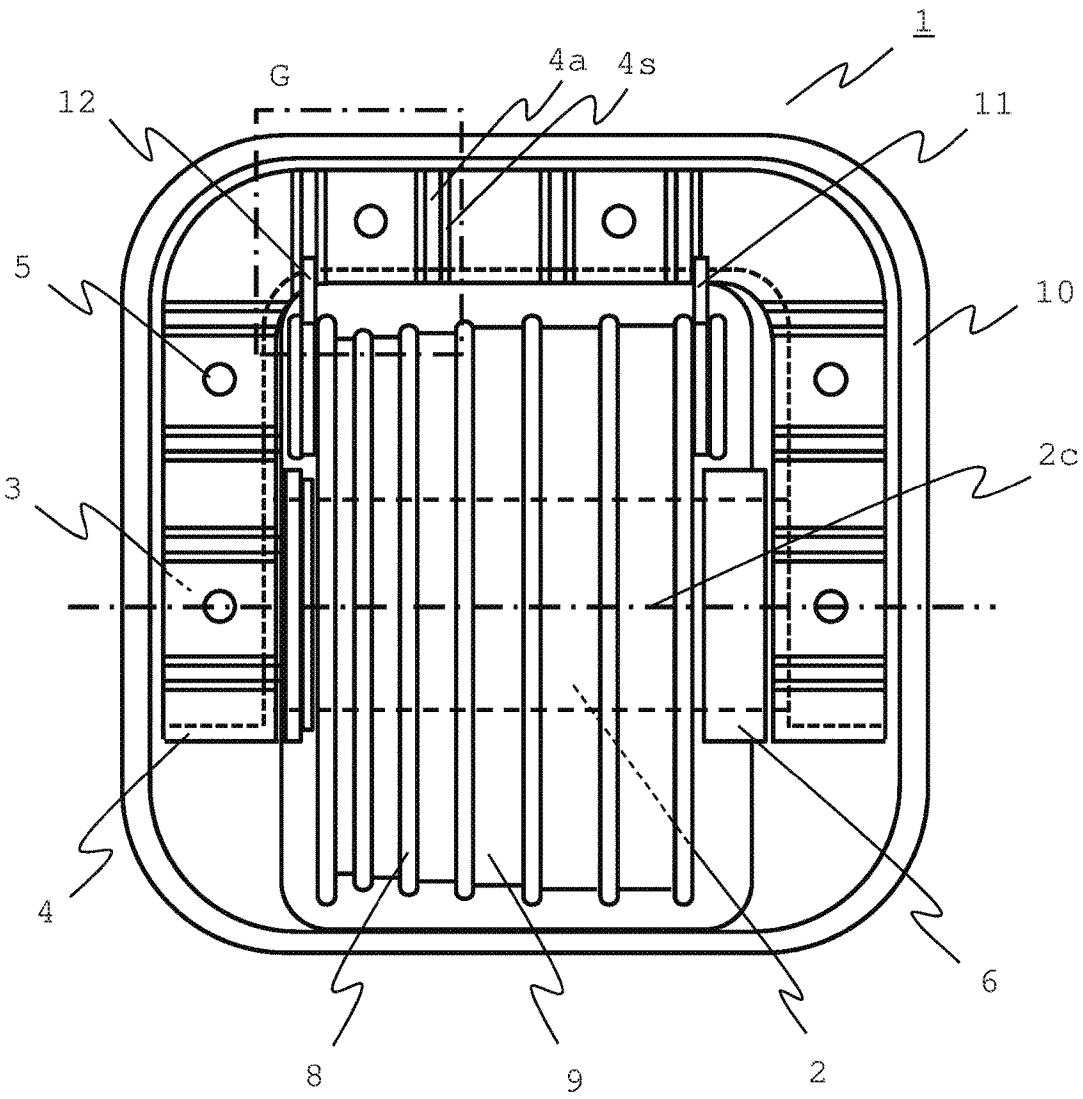
FIG. 15 is a plan view illustrating the structure of a fourth aspect of the internal combustion engine ignition device according to embodiment 3.
Figure 16:
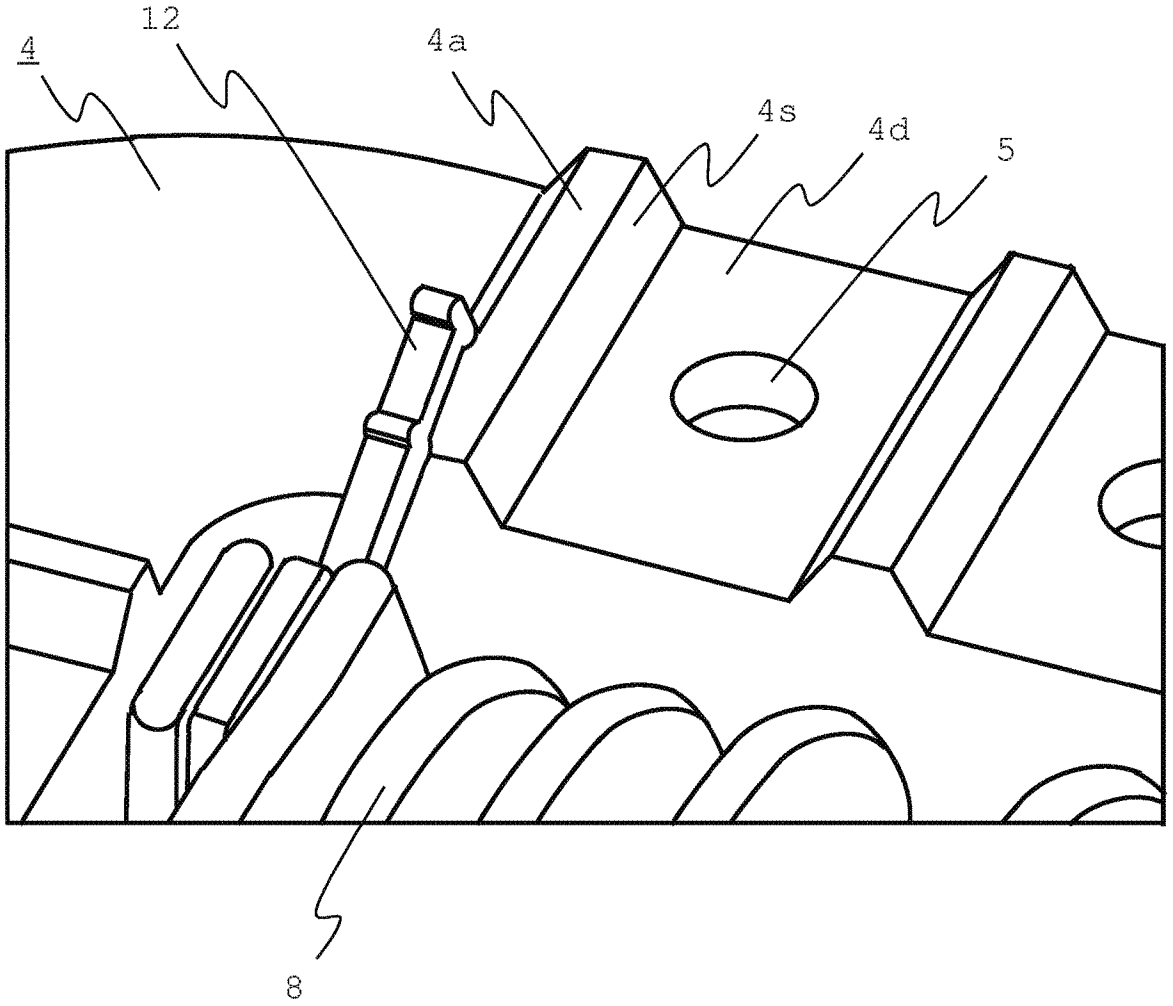
FIG. 16 is a partial perspective view illustrating section G in FIG. 15.

In addition, FIG. 15 is a plan view illustrating the structure of the fourth aspect of the internal combustion engine ignition device according to embodiment 3. FIG. 16 is a partial perspective view illustrating section G in FIG. 15. Here, a side 4*s* of the ridge 4*a* provided on the resin 4 has an inclined surface formed between an end portion and a bottom portion larger than the end portion. Accordingly, the insulating resin 14 is sufficiently distributed onto the surface portion of the resin 4 when the through hole is filled with the insulating resin 14 and the contact is improved in this aspect.

As described above, in the internal combustion engine ignition device according to embodiment 3, the same effects as in embodiment 1 can be obtained and the exfoliation of the resin can be suppressed by providing a ridge on the resin covering the side core.

In addition, individual embodiments may be combined freely or individual embodiments may be modified or omitted as appropriate within the scope of the invention.

In addition, the same reference numeral represents the same component or an equivalent component in the drawings.

REFERENCE SIGNS LIST

1: internal combustion engine ignition device
2: center core
3: side core
3*s*: outer peripheral side
4: resin
4*a*: ridge
4*s*: side
4*c*: edge portion
4*d*: flat portion
5, 17, 18: through hole
6: primary bobbin
7: primary coil
8: secondary bobbin
9: secondary coil
10: housing
11: low voltage side terminal
12: high voltage side terminal
13: permanent magnet
14: insulating resin
15: switching module
16: elastic body

The invention claimed is:

1. An internal combustion engine ignition device comprising:

a center core having a center axis, a first end surface and a second end surface opposite the first end surface;

a primary coil wound on an outside of the center core;

a secondary coil wound around an outside of the primary coil;

a permanent magnet abutted against the first end surface of the center core, the permanent magnet being magnetized in a direction opposite to a direction of a magnetic flux produced by energization of the primary coil;

a side core disposed on an outside of the secondary coil with a first end abutted against the permanent magnet and a second end abutted against the center core such that the center axis penetrates the side core, and such that the side core interacts with the permanent magnet to form a closed magnetic path, wherein the first end of the side core, the second end of the side core, and the center axis of the center core extend in a horizontal plane;

a resin being heat-resistant and elastic and covering a plurality of interior surfaces of the side core; and a housing, wherein a gap is disposed between the housing and the side core, the gap is configured such that an open face exists on the side core, the gap beginning at the open face of the side core and extending to the housing in the direction of the center axis, the side core having a first height, the gap disposed with a second height substantially equal to the first height such that the resin is opened over an outer peripheral side of the side core, and the gap is configured such that a heat flow, during operation, passes from the open face of the side core in the direction of the center axis to the housing for dissipation, wherein the resin is further configured with a first through hole and a second through hole, the first through hole configured above the horizontal plane and above the side core and the second through hole configured below the horizontal plane and below the side core, such that a line passing from the second through hole to the first through hole passes through the side core.

2. The internal combustion engine ignition device according to claim 1, wherein a first diameter of the first through hole on an exterior surface of the resin is larger than a second diameter of the first through hole close to the side core, and a third diameter of the second through hole on the exterior surface of the resin is larger than a fourth diameter of the second through hole close to the side core.

3. The internal combustion engine ignition device according to claim 1 wherein a first thickness of an edge portion of the resin is larger than a second thickness of the resin on an inner peripheral surface of the side core.

4. The internal combustion engine ignition device according to claim 1, wherein a ridge is provided on a surface of the resin.

5. The internal combustion engine ignition device according to claim 4, wherein a side of the ridge is an inclined surface formed between an end side and a bottom side larger than the end side.

6. The internal combustion engine ignition device according to claim 4, wherein the secondary coil is provided with a high voltage side terminal and a flat portion of the resin is provided in a position facing the high voltage side terminal.

7. The internal combustion engine ignition device according to claim 1, wherein the internal combustion engine ignition device supplies an internal combustion engine a high voltage induced in the secondary coil by passing a primary current through the primary coil.

8. The internal combustion engine ignition device according to claim 7, wherein the internal combustion engine ignition device supplies the internal combustion engine the high voltage induced in the secondary coil by interrupting the primary current.

9. The internal combustion engine ignition device according to claim 1, wherein the side core has a U-shape, a first end of the U-shape is parallel to a second end of the U-shape, the parallel first end and second end extending in the horizontal plane and forming a part of the closed magnetic path.

10. The internal combustion engine ignition device according to claim 1, wherein the gap is further configured to prevent a reduction in a dielectric voltage strength of the secondary coil, by avoiding crack generation in an insulating resin from an edge of the side core.

11. The internal combustion engine ignition device according to claim 10, wherein the gap is further configured to permit the heat flow to pass from the primary coil and the secondary coil via the open face of the side core to the housing for dissipation, the gap is further configured to be penetrated by the center axis, and the gap is configured to contain substantially no resin, thereby promoting the heat flow to pass from the side core to the housing in the direction of the center axis.

12. The internal combustion engine ignition device according to claim 1, wherein the gap is closer to the second end surface of the center core than to the first end surface of the center core.

13. The internal combustion engine ignition device according to claim 1, the center core having a top surface and a bottom surface, the center core having a second height extending vertically, the second height of the center core being less than the first height of the side core such that the side core extends both above the top surface of the center core and below the bottom surface of the center core.

14. An internal combustion engine ignition device comprising:

a center core having a center axis, a first end surface and a second end surface opposite the first end surface;

a primary coil wound on an outside of the center core;

a secondary coil wound around an outside of the primary coil;

a permanent magnet abutted against the first end surface of the center core, the permanent magnet being magnetized in a direction opposite to a direction of a magnetic flux produced by energization of the primary coil;

a side core disposed on an outside of the secondary coil with a first end abutted against the permanent magnet and a second end abutted against the center core such that the center axis penetrates the side core, and such that the side core interacts with the permanent magnet to form a closed magnetic path, wherein the first end of the side core, the second end of the side core, and the center axis of the center core extend in a horizontal plane;

a resin being heat-resistant and elastic and covering a plurality of interior surfaces of the side core; and a housing, wherein a gap is disposed between the housing and the side core, the gap is configured such that an open face exists on the side core, the gap beginning at the open face of the side core and extending to the housing in the direction of the center axis, the side core having a first height, the gap disposed with a second height substantially equal to the first height such that the resin is opened over an outer peripheral side of the side core, and the gap is configured such that a heat flow, during operation, passes from the open face of the side core in the direction of the center axis to the housing for dissipation, wherein an edge portion of the resin has a curved surface, wherein the curved surface is characterized by a curvature R and is configured to curve from a horizontal line to a vertical line, the vertical line is approximately tangential to an outer peripheral surface of the side core, and the curved surface is configured to suppress an exfoliation of the resin during an assembly of the internal combustion engine ignition device.

15. An internal combustion engine ignition device comprising:

a center core having a center axis, a first end surface and a second end surface opposite the first end surface;

a primary coil wound on an outside of the center core;

a secondary coil wound around an outside of the primary coil;

a permanent magnet abutted against the first end surface of the center core, the permanent magnet being magnetized in a direction opposite to a direction of a magnetic flux produced by energization of the primary coil;

a side core disposed on an outside of the secondary coil with a first end abutted against the permanent magnet and a second end abutted against the center core such that the center axis penetrates the side core, and such that the side core interacts with the permanent magnet to form a closed magnetic path, wherein the first end of the side core, the second end of the side core, and the center axis of the center core extend in a horizontal plane;

a resin being heat-resistant and elastic and covering a plurality of interior surfaces of the side core; and a housing, wherein a gap is disposed between the housing and the side core, the gap is configured such that an open face exists on the side core, the gap beginning at the open face of the side core and extending to the housing in the direction of the center axis, the side core having a first height, the gap disposed with a second height substantially equal to the first height such that the resin is opened over an outer peripheral side of the side core, and the gap is configured such that a heat flow, during operation, passes from the open face of the side core in the direction of the center axis to the housing for dissipation, wherein a T-shaped through hole is provided in the resin.

* * * * *